US010662576B2

(12) United States Patent
Bringewatt et al.

(10) Patent No.: US 10,662,576 B2
(45) Date of Patent: May 26, 2020

(54) METHOD FOR IRONING ITEMS OF LAUNDRY, AND BAND IRONER

(71) Applicant: Herbert Kannegiesser GmbH, Vlotho (DE)

(72) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 71 days.

(21) Appl. No.: 16/011,630

(22) Filed: Jun. 18, 2018

(65) Prior Publication Data

US 2018/0363235 A1 Dec. 20, 2018

(30) Foreign Application Priority Data

Jun. 19, 2017 (DE) ..... 10 2017 005 710

(51) Int. Cl.
*D06F 69/02* (2006.01)
*D06F 67/02* (2006.01)
*D06F 67/10* (2006.01)

(52) U.S. Cl.
CPC ..... *D06F 69/02* (2013.01); *D06F 67/02* (2013.01); *D06F 67/10* (2013.01)

(58) Field of Classification Search
CPC ..... D06F 69/00; D06F 69/02; D06F 69/04; D06F 67/00; D06F 67/02; D06F 67/10;
(Continued)

(56) References Cited

U.S. PATENT DOCUMENTS 1,842,297 A * 1/1932 Silverstine ..... D06F 67/00 38/9
1,889,690 A * 11/1932 Morris ..... D06F 67/00 193/17

(Continued)

FOREIGN PATENT DOCUMENTS

DE 3602892 A1 8/1987
DE 19944327 A1 * 3/2001

(Continued)

OTHER PUBLICATIONS

European Patent Office, Europaischer Recherchenbericht (search in a related application, dated Nov. 7, 2018.

(Continued)

*Primary Examiner* — Ismael Izaguirre
(74) *Attorney, Agent, or Firm* — Laurence P. Colton; Smith Tempel Blaha LLC

(57) ABSTRACT

A method and device allowing the items of laundry which are to be ironed to enter the ironer gap in a manner directed downwards. For this purpose, the inlet region is preferably arranged below the outlet region. The invention ensures a disturbance-free and crease-free entry of items of laundry to be ironed into the band ironer. In the case of band ironers, the inlet region, and outlet region have to lie tightly together in order to bring about as large a wrapping angle of the ironer body by means of the ironer band as possible. This makes the inlet of items of laundry to be ironed into the ironer gap emerging from the inlet region problematic. This invention described herein provides a solution to this problem.

20 Claims, 3 Drawing Sheets

(58) Field of Classification Search
CPC ..... D06F 67/06; D06F 67/08; D06F 63/00; D06F 63/02; D06F 65/00; D06F 65/02
See application file for complete search history.

(56) References Cited

U.S. PATENT DOCUMENTS

| | | | | | |
|---|---|---|---|---|---|
| 2,036,769 | A | | 4/1936 | Myers | |
| 2,568,451 | A | * | 9/1951 | Kahl | D06F 67/00 38/11 |
| 2,768,092 | A | * | 10/1956 | Lawrence | D06Q 1/08 264/137 |
| 3,797,141 | A | | 3/1974 | Parera | |
| 4,102,643 | A | * | 7/1978 | Riedel | D06C 7/00 34/123 |

FOREIGN PATENT DOCUMENTS

| | | | | |
|---|---|---|---|---|
| FR | 1544981 | A | | 11/1968 |
| WO | WO 0202858 | A1 | * | 1/2002 |

OTHER PUBLICATIONS

Deutsches Patent—Und Markenamt (German Patent and Trademark Office), Recherchenbericht (searchin a related application), dated Sep. 25, 2017.
DIN 11 909: Mangeln—Begriffe, Maschinenausfuhrungen, Anfordenrungen. Beuth Verlag. Berlin. Jul. 1975.

* cited by examiner

METHOD FOR IRONING ITEMS OF LAUNDRY, AND BAND IRONER

STATEMENT OF RELATED APPLICATIONS

This application claims priority on and the benefit of German Patent Application No. 10 2017 005 710.9 having a filing date of 19 Jun. 2017.

BACKGROUND OF THE INVENTION

Technical Field

The invention relates to a method for ironing items of laundry with a band ironer, preferably a band ironer comprising one ironer body and at least one circumferentially drivable ironer band, which is assigned to the ironer body of the band ironer, and defining an ironer gap, which extends from an inlet region as far as an outlet region, between the at least one ironer body and the at least one ironer band, wherein the ironer body is positionally fixed and stationary, and wherein the ironer gap is configured to have the items of laundry to be ironed supplied therein, in a manner directed downward in the inlet region. Furthermore, the invention relates to a band ironer, preferably, a band ironer comprising at least one heatable ironer body and at least one circumferentially drivable ironer band, which is assigned to the at least one ironer body, and defining an ironer gap between the at least one ironer body and the at least one ironer band, from an inlet region at the beginning of the ironer gap, in the ironing direction, as far as the outlet region at the end of the ironer gap, wherein the ironer body is configured to be positionally fixed and stationary, and the inlet region is arranged lower than the outlet region.

Prior Art

In commercial Items of laundry, specifically especially what are referred to as, flat items of laundry are smoothed by ironers. There are various structural forms of such ironers. The invention relates to what are referred to as band ironers. Such band ironers have at least one ironer body and at least one ironer band wrapping for the most part around the outside of the latter. An ironer gap is formed between that portion of the respective ironer band which wraps around the at least one ironer body, through which ironer gap the item of laundry can be transported by the circumferentially driven ironer band. The at least one ironer body is preferably configured to be stationary, but can also be driven in a rotating manner.

The pressing surface is bounded by an inlet region and an outlet region. As seen in the ironing direction of the items of laundry through the ironer gap, the inlet region is located at the beginning of the ironer gap and the outlet region at the rear end of same. At the inlet region, the items of laundry to be ironed are supplied to the band ironer. Ironed items of laundry are transported out of the band ironer at the outlet region.

In the case of known band ironers, it has proven difficult to supply the items of laundry to the inlet region in a disturbance- and especially crease-free manner such that they can enter said inlet region in a likewise disturbance- and crease-free manner.

BRIEF SUMMARY OF THE INVENTION

The invention is based on the object of providing a method for ironing items of laundry and a band ironer which ensure a disturbance- and crease-free supplying of items of laundry to be ironed to and into the inlet region and preferably also problem-free transporting away of an ironed item of laundry out of the outlet region.

A method for achieving this object has the features of ironing items of laundry between at least one ironer body and at least one circumferentially drivable ironer band, which is assigned to the ironer body, of a band ironer, the items of laundry being transported by the ironer band in the ironing direction through an ironer gap, which extends from an inlet region as far as an outlet region, between the at least one ironer body and the at least one ironer band, wherein the ironer body is positionally fixed and stationary, and the items of laundry to be ironed are supplied to the ironer gap in a manner directed downward in the inlet region. According thereto, the items of laundry to be ironed are supplied, with the ironer body positionally fixed and stationary, in a downwardly directed manner in the inlet region to the ironer gap. As a result, the items of laundry can automatically enter the ironer gap in a disturbance- and substantially also crease-free manner at the beginning of the ironer gap in a manner substantially following gravity and/or assisted by preferably only the at least one ironer band.

In this method, it is preferably provided to supply the items of laundry in an inlet region of the band ironer, said inlet region being located lower than the outlet region. The lower inlet region makes it possible structurally to supply the items of laundry to be ironed directly from above to the ironer gap, in particular to the beginning of the ironer gap. As a result, the risk of disturbances during the entry of items of laundry to be ironed into the ironer gap is reduced and the creasing is at least reduced.

The items of laundry are preferably supplied into a lower inlet region at or with a small distance above a horizontal longitudinal center plane through a longitudinal center axis of the at least one ironer body. The transporting away of ironed items of laundry in the outlet region preferably takes here at a greater distance above the horizontal longitudinal center plane. As a result, the at least one ironer gap can be brought up to the inlet region in such a manner that there is the possibility spatially of transporting the items of laundry to be ironed in a directly downwardly directed manner to the beginning of the ironer gap and/or into the ironer gap such that the items of laundry almost drop into the ironer gap.

In an advantageous possibility of refining the method, it is provided that the items of laundry to be ironed are brought into contact in the inlet region first of all with the ironer band, which is moved further downward in the ironing direction shortly upstream of the ironer gap, before said items of laundry come into contact with the ironer surface of the or the respective ironer body and/or enter with their respective leading transverse edge into the ironer gap.

A preferred possibility of developing the method makes provision, at the lower inlet region of the band ironer, to deflect the at least one ironer band by at least 180° on an optionally driven deflecting drum. As a result, the at least one ironer band has an upwardly closed U-shaped profile in the inlet region, and therefore the inlet region of the band ironer is configured as a type of edge. Such an edge region is realized by the U-shaped deflection of the at least one ironer band by means of a deflecting drum at the lower inlet region of the band ironer according to the invention. This is therefore in particular also because or if the deflecting drum of the at least one ironer band has a relatively small diameter in the inlet region.

It is preferably provided, in the lower inlet region, to introduce the items of laundry to be ironed directly into the ironer gap and/or to transport same to the beginning of the ironer gap. This can take place, for example, by means of a supply conveyor of an input machine arranged upstream of the band ironer. Also because of said direct input of items of laundry to be ironed into the ironer gap, the risk of disturbances during the supplying of items of laundry to be ironed to the band ironer and also creasing during the supply operation is eliminated or at least reduced.

The method can advantageously be developed by the assignment of the higher outlet region to that side of the at least one ironer body to which the inlet region is assigned. The inlet region and the outlet region are then located on the same side of the at least one ironer body. This is preferably the same side on which the items of laundry to be ironed are supplied to the band ironer. The outlet region is preferably located with a small distance above and/or obliquely above the inlet region. From here, ironed items of laundry can be transported away by the at least one ironer band beyond the at least one ironer body onto that side of the band ironer which lies opposite the supply side with the inlet region. However, it is also conceivable to transport away ironed items of laundry from the outlet region on the same side, i.e. beyond the supply of items of laundry to be ironed to the inlet region. The method according to the invention thus not only permits the disturbance- and crease-free supplying of items of laundry to be ironed to the band ironer, but also the desired reliable transporting away of ironed items of laundry without impairing the ironing quality.

The method can be developed to the effect that at least one discharging aid is assigned to the outlet region. This ensures that the ironed items of laundry are discharged from the at least one ironer body in the outlet region, and therefore they can be transported away from the ironer band, while maintaining their contact with the at least one ironer band, and/or can be transferred to a removal conveyor.

A band ironer for achieving the object mentioned at the beginning has the features of a band ironer for ironing items of laundry, comprising at least one heatable ironer body and at least one circumferentially drivable ironer band which is assigned to the at least one ironer body, the items of laundry being transported by the at least one ironer band through an ironer gap between the at least one ironer body and the at least one ironer band from an inlet region at the beginning of the ironer gap, as seen in the ironing direction, as far as the outlet region at the end of the ironer gap, wherein the ironer body is configured to be positionally fixed and stationary, and the inlet region is arranged lower than the outlet region. In the case of this band ironer, it is provided to configure the ironer body to be stationary and positionally fixed and to arrange the inlet region lower than the outlet region. As a result, the items of laundry to be ironed can pass directly into the inlet region, preferably below the outlet region. Above all, the at least one ironer band can thereby be brought up to the inlet region in a spatially tight manner. The inlet region can also be arranged on that side of the band ironer from which items of laundry to be ironed are transported up to the band ironer, for example by an input machine.

In a preferred refinement of the invention, the inlet region is arranged on a horizontal longitudinal center plane through a longitudinal center axis of the at least one ironer body or with a small distance from, in particular above, the horizontal longitudinal center plane. By contrast, the outlet region is preferably arranged with a larger distance above the longitudinal center plane. Since the inlet region is arranged on or tightly at the horizontal longitudinal center plane mentioned, the items of laundry to be ironed can enter the ironer gap, in particular the beginning thereof, laterally from above in a manner following gravity. The items of laundry to be ironed drop or slip virtually automatically from above into the ironer gap, which prevents or at least reduces disturbances and creasing during the entry of items of laundry to be ironed into the ironer gap. As a result, the items of laundry to be ironed preferably come into contact with the at least one ironer band on the inlet side only shortly upstream of the beginning of the ironer gap or optionally also only at the beginning of the ironer gap. This promotes or permits the direct supply of items of laundry to be ironed to the inlet region of the band ironer, preferably without any inlet aids.

According to an advantageous refinement of the band ironer, the inlet region and the outlet region are assigned to the same side of the at least one ironer gap. The outlet region is preferably arranged here with a small distance above or virtually or obliquely above the inlet region.

By means of at least one of the aforementioned features, as large a wrapping angle of the at least one ironer body by the at least one ironer band as possible can be brought about, as a result of which a high performance is ensured. Equally, items of laundry to be ironed can be supplied directly and preferably without a supply aid at the inlet region to the ironer gap and can enter the ironer gap here at least substantially in a disturbance- and crease-free manner.

The lower inlet region is preferably located on that side of the band ironer and/or of the at least one ironer body of the same from which the items of laundry to be ironed are transported to the band ironer. This permits the supplying of items of laundry to be ironed to the band ironer on the shortest path. The items of laundry to be ironed can especially be supplied to the band ironer in such a manner that they come into contact with the at least one ironer band only or directly and/or shortly upstream of the beginning of the ironer gap. It is preferably provided that the items of laundry to be ironed enter into contact with at least one ironer band in the inlet region at the same time as or only shortly before coming into contact with the at least one ironer body.

The band ironer can be developed in an advantageous manner by the fact that at least one discharging means for ironed items of laundry is assigned to the outlet region arranged on the side of the inlet region somewhat above, in particular obliquely above, same. The at least one discharging means ensures that, for the transporting way of ironed items of laundry by the ironer band, the respective item of laundry is discharged from the at least one ironer body in the outlet region and remains in contact with the at least one ironer band.

In an advantageous development of the band ironer, the at least one ironer band is guided back from the outlet region on the outside around the at least one ironer body, preferably beyond the at least one inlet region, to the inlet region.

It may be advantageous to develop the band ironer in such a manner that the at least one ironer band is guided from the outlet region beyond the at least one ironer body to that side of the at least one ironer body which lies opposite the outlet region and the inlet region. This makes it possible to transport away ironed items of laundry on that side of the band ironer which lies opposite the supply of items of laundry to be ironed, in particular the at least one ironer body of said band ironer. Items of laundry to be ironed are thus directly supplied to the inlet region on the one side and ironed items of laundry are indirectly transported away, by interconnection of an exposed upper strand of the at least one ironer band, on the other side, in particular the side of the band ironer lying opposite the inlet and outlet side. This permits the customary arrangement of laundry machines also downstream of the respective band ironer.

BRIEF DESCRIPTION OF THE DRAWINGS

A preferred exemplary embodiment of the invention is described in more detail in the following on the basis of the drawing, in which.

DETAILED DESCRIPTION OF PREFERRED EMBODIMENTS

The figures show various ironer lines with a band ironer 10 or else only the band ironer 10. The band ironer 10 serves for ironing in particular flat laundry, such as covers, pillow cases, but also table cloths, serviettes or the like. During the ironing in the band ironer 10, the items of laundry (not illustrated in the figures) are at least for the most part freed from their residual moisture and smoothed.

Figure 1:
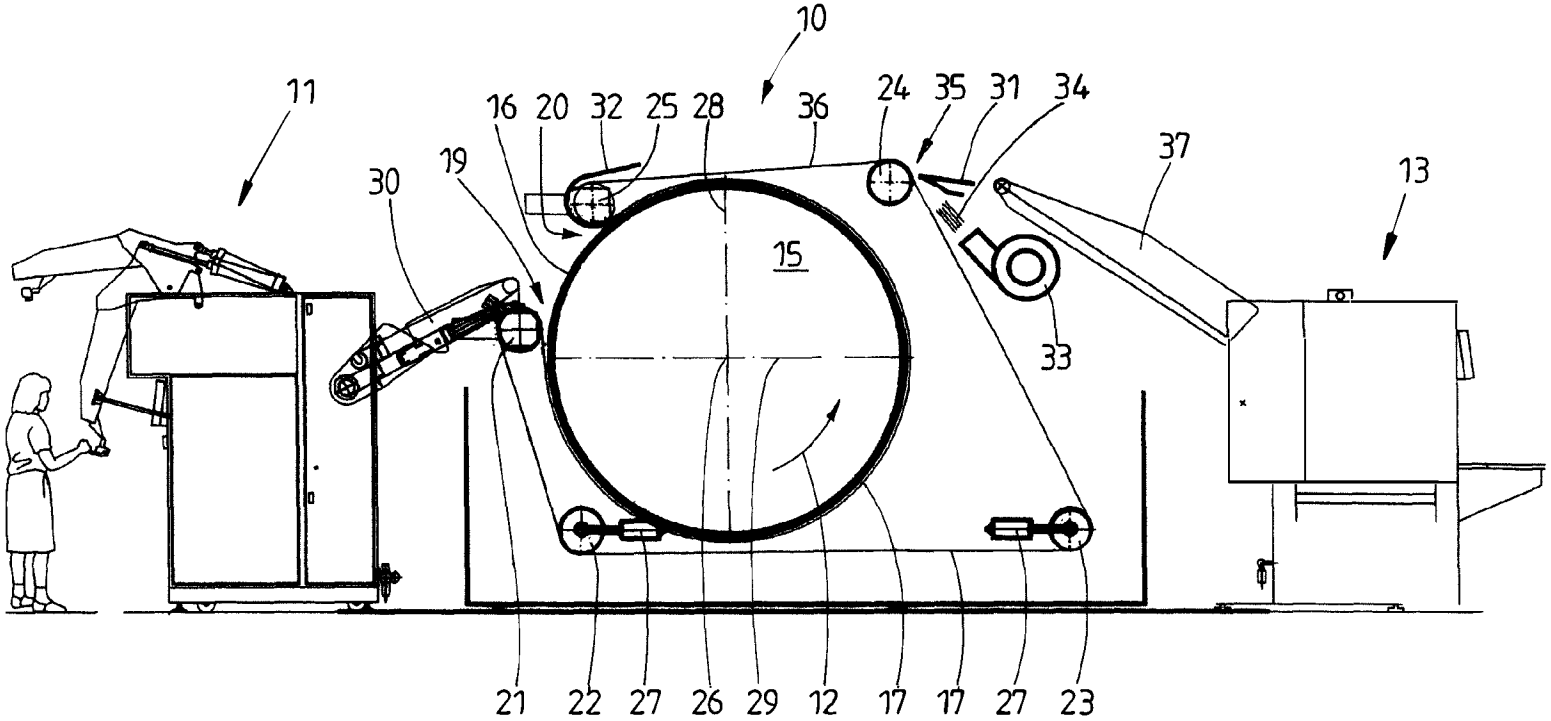
FIG. 1 shows a schematic side view of an ironer line with a band ironer.

The ironer line shown in FIG. 1 has an input machine 11 followed in the ironing direction 12 or pass-through direction of the items of laundry through the ironer line by the band ironer 10 and, downstream thereof, a folding machine 13.

Figure 2:
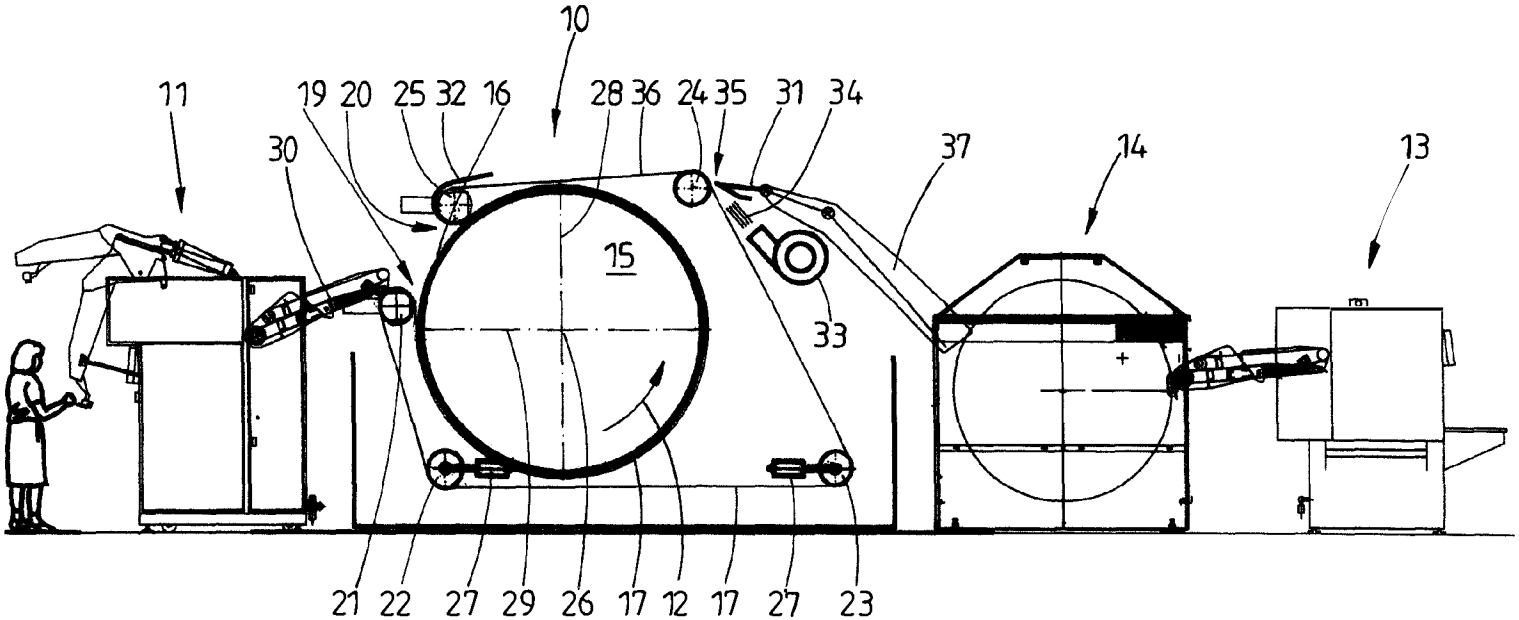
FIG. 2 shows a schematic side view of another ironer line with the band ironer.
Figure 3:
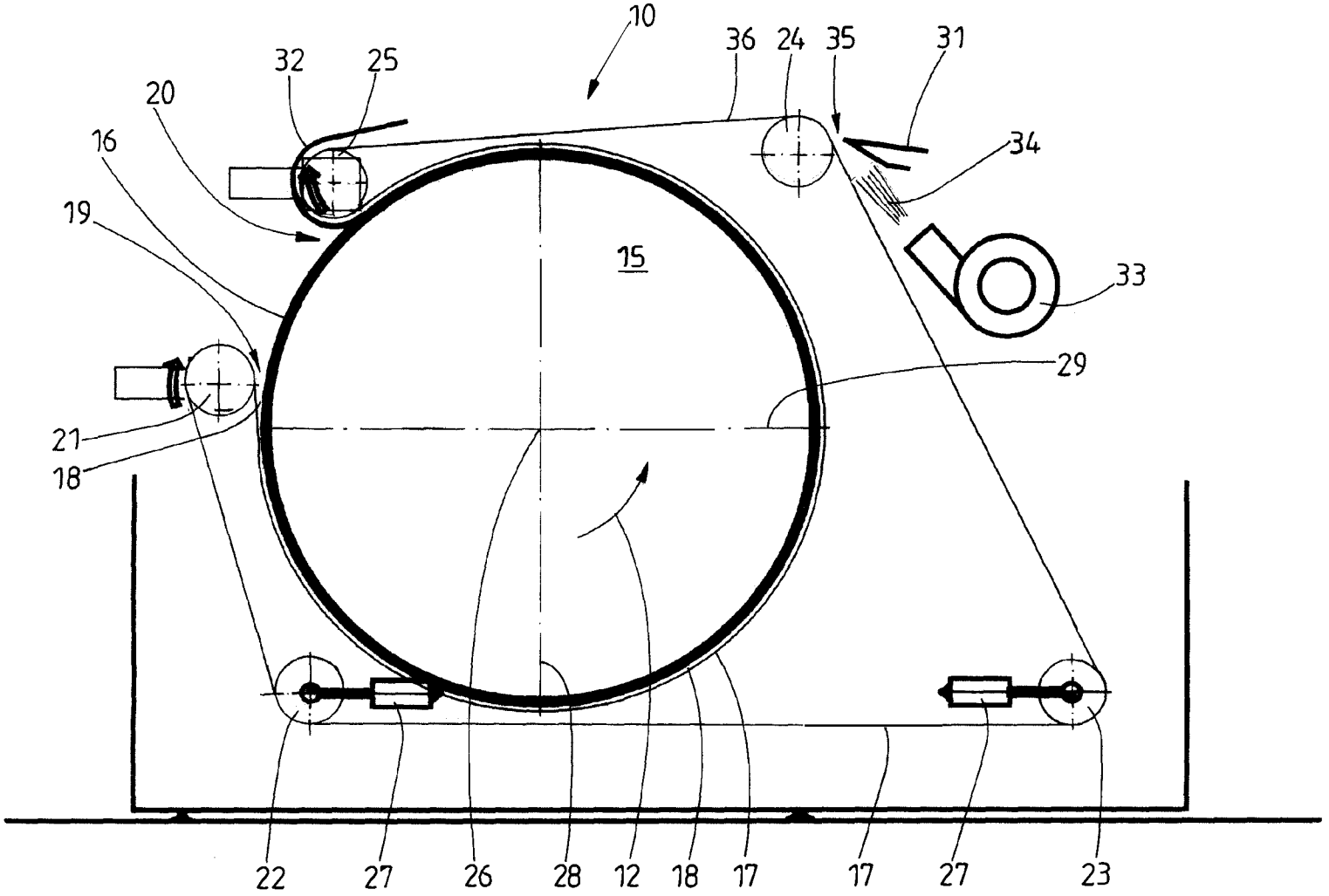
FIG. 3 shows an enlarged schematic side view only of the band ironer.

In the case of the ironer line of FIG. 2, downstream of the input machine 11 and the band ironer 10, following the latter, a conventional chest ironer 14 is provided and, following the latter, the folding machine 13.

The input machine 11, which is designed in a conventional manner, the folding machine 13, and the chest ironer 14, or other ironer, will now be discussed in more detail below.

In the exemplary embodiment shown, the band ironer 10 has a positionally fixed, stationary cylindrical ironer body 15, and an endless and circumferentially drivable ironer band 17, which surrounds a cylindrical lateral surface 16 of said ironer body 15, for the most part, preferably approximately by 300° to 330°. The cylindrical ironer body 16 can optionally be drivable in a rotating manner. This preferably takes place such that a slip arises between the ironer body 15 and the ironer band 17. The ironer body 15 does not need—as illustrated in the FIGS—to be of cylindrical design. On the contrary, it can have any other cross sections. Such an ironer body is not driven in a rotating manner, i.e. is stationary.

The ironer body 15 of the band ironer 10 is heated from the inside. This heating can be undertaken with steam, thermal oil, burner flames, but also electrically and/or with infrared radiation. As a result of the heating of the ironer body 15, the lateral surface 16 thereof is heated up for heating or warming the items of laundry to be ironed by the band ironer 10.

An ironer gap 18 is formed between the lateral surface 16 of the ironer body 15 and that portion of the ironer band 17, which is wrapping at the particular instants around the ironer body 15. The ironer gap 18 is bounded on both sides by an inlet region 19 of the band ironer 10 on one side, and an outlet region 20 of the band ironer 10 on the other side. As seen in the ironing direction 12, the inlet region 19 is located at the front, transversely directed end of the ironer gap 18 and the outlet region 20 at the rear, transversely directed end of the ironer gap 18. The ironer gap 18 is bounded on the inside by the lateral surface 16 of the ironer body 15 and on the outside by that portion of the ironer band 17, which is wrapping around the ironer body 15 on the outside at the particular instant. As a result of the continuously encircling drive of the ironer band 17, the items of laundry, which are located in the ironer gap 18 and are to be ironed, are moved by said drive along the heated lateral surface 16 of the ironer body 15. A slip occurs here between the items of laundry and the lateral surface 16 of the ironer body 15, said slip providing the items of laundry which are to be ironed with a "finish" on the surface, in particular inner surface, sliding along the lateral surface 16 of the ironer body 15.

The endless ironer band 17 is guided up to the ironer body 15 at the inlet region 19 and discharged from the ironer body 15 at the outlet region 20. The ironer band 17, which is discharged from the ironer body 15 at the outlet region 20, is returned on the outside around the ironer body 15 to the inlet region 19. For this purpose, the band ironer 10 has, in the exemplary embodiment shown, five deflecting drums 21 to 25, the longitudinal center axes of which run parallel to the longitudinal center axis 26 of the cylindrical ironer body 15, wherein, in the exemplary embodiment shown, the distances of the longitudinal center axes of the deflecting drums 21 to 25 from the longitudinal center axis 26 of the ironer body 15 differ. At least one of the deflecting drums 21 to 25 is driven in a rotating manner with respect to the circumferential drive of the ironer band 17.

In the exemplary embodiment shown, all of the deflecting drums 21 to 25 are of identical design. They in particular have identical diameters. In addition, in the exemplary embodiment shown, the two lower deflecting drums 22, 23 are changeable in position, namely are displaceable transversely by means of pressure medium cylinders 27, in order to tension the ironer band 17.

Alternatively, it is conceivable for the ironer band 17 to be deflected by more or fewer than five deflecting drums 21 to 25. The deflecting drums 21 to 25 can also have different diameters. In particular, it can be provided that the deflecting drum 21 assigned to the inlet region 19 has a smaller diameter than the remaining deflecting drums 22 to 25. Finally, it may be sufficient to design only one deflecting drum 22, 23 or 24 to be changeable in position, in particular displaceable transversely, in order to tension the ironer band 17.

According to the invention, the inlet region 19 is arranged at a lower point than the outlet region 20. The outlet region 20 is located here above, in particular, slightly obliquely above the inlet region 19. The horizontal distance of the outlet region 20, from a vertical longitudinal center plane 28 of the ironer body 15, is somewhat smaller here than the distance of the inlet region 19 from said vertical longitudinal center plane 28. As a result, not only is the lower inlet region 19, but also the higher outlet region 20, located in the vicinity of the cylindrical lateral surface 16 of the ironer body 15. In the exemplary embodiments shown, the lower inlet region 19 is located somewhat above a horizontal longitudinal center plane 29 through the longitudinal center axis 26 of the ironer body 15. However, the inlet region 19 can also lie on or optionally below the horizontal longitudinal center plane 29.

Both the inlet region 19 and the outlet region 20 are located on that side of the band ironer 10, in particular, the ironer body 15 thereof, from which the items of laundry, which are to be ironed are supplied to the band ironer 10, in particular, the ironer body 15 thereof. In the exemplary embodiment shown, this is that side of the band ironer 10 which faces the input machine 11.

As a result of the outlet region 20 lying obliquely above the inlet region 19, ironed items of laundry also leave the ironer gap 18 on that side of the band ironer 10 on which the items of laundry are supplied thereto, i.e. on the side of the input machine 11 in the case of the exemplary embodiments shown. Ironed items of laundry leaving the outlet region 20 are therefore transported above the ironer body 15 from the deflecting drum 25 in the outlet region 20 to the deflecting drum 24, which follows in the pass-through direction, in a manner lying on the returned upper strand of the ironer band 17, as seen in the pass-through direction of the items of laundry through the ironer line, or slightly obliquely with respect thereto onto the other side directed away from the input machine 11, in particular rear side, of the band ironer 10. From here, the ironed items of laundry are transferred at the rear deflecting drum 24 onto a transfer conveyor 30 pointing toward the folding machine 13 or the chest ironer 14.

In the case of the band ironer 10 shown, a discharging means 31 is assigned to an outlet region 20. This is a guide plate which is for the most part guided around the ironer band 17 in the region of the deflecting drum 25 and preferably has good sliding properties, for example, by means of an anti-adhesive coating, on the side directed toward the ironed items of laundry. The guide plate 32 is preferably connected without a transition by a front transverse edge, as seen in the ironing direction 12, at the end of the ironer gap 18 to the lateral surface 16 of the ironer body 15 and is thus held in a positionally fixed manner in the outlet region 20. From the guide plate 32, the ironed items of laundry are discharged at the end of the ironer gap 18 from the lateral surface 16 of the ironer body 15 and slightly pressed onto the ironer band 17, and therefore the ironer band 17 can continuously guide the ironed items of laundry from the end of the ironer gap 18 about approximately half the circumference of the deflecting drum 25 onto an upper strand or strand 36 of the ironer band 17 that subsequently runs approximately horizontally over the ironer body 15.

A further discharging means is assigned in the transition from the strand 36, in particular upper strand, which is guided in an exposed manner beyond the ironer body 15, of the ironer band 17 between the deflecting drum 24 and a bridge 31 to the transfer conveyor 30. Said transfer means is a type of fan 33 or similar for generating an upright air stream 34 in a gap 35 between the deflecting drum 24 and the beginning of the bridge 31. The air stream 34 ensures that ironed items of laundry reliably pass from the strand 36 of the ironer band 17 in the region of the deflecting drum 24 onto the bridge 31.

The method according to the invention will be explained in more detail below with reference to the above description of the FIGS.

The items of laundry to be ironed pass from the input machine 11 or spread out in some other way to the inlet region 19 of the band ironer 10. By being entrained by the circumferentially driven ironer band 17, the items of laundry 10 are transported sliding along the lateral surface 16 of the ironer body 15 from the inlet region 19 through the ironer gap 18 and, in the process, ironed, namely smoothed under the action of heat and dried or redried. The ironed items of laundry leaving the ironer gap 18 at the outlet region 20 are then discharged by the guide plate 13 from the ironer surface 16 of the ironer body 15 and pressed in the region of the deflecting drum 15 at the outlet region 20 against the ironer band 17 such that the latter can deflect the ironed items of laundry about approximately half the circumference of the deflecting drum 25. Subsequently, the ironed items of laundry lie at the top on the strand 36 of the ironer band 17, which strand is guided beyond the ironer body 15 between the deflecting drums 24 and 25. The ironed items of laundry are then transported on the strand 36 of the ironer band 17 by the latter to the side opposite the outlet region 20 and the inlet region 19 lying therebelow, in particular the rear side, of the band ironer 10. In the region of the rear upper deflecting drum 24, the ironed items of laundry are then transported by the upper strand 36 of the ironer band 17 to the bridge 31 and from the latter to the transfer conveyor 30. The upright airstream 34 in the gap 35 ensures here that the ironed items of laundry pass beyond the gap 35 onto the bridge 31.

The ironed items of laundry are subsequently transported by the transfer conveyor 30 either directly to the folding machine 13 (FIG. 1) or to a chest ironer 14 following the band ironer 10, or to some other ironer. The chest ironer 14 once again irons the items of laundry ironed by the band ironer 10, wherein the other side of the items of laundry is preferably provided with a finish. Subsequently, the ironed items of laundry provided twice, in particular on both sides, with a finish by repeated ironing are supplied from the chest ironer 14 to the folding machine 13 and folded by the latter. Alternatively or else additionally, at least one chest ironer or another ironer can also be arranged upstream of the band ironer (10).

According to the invention, the method makes provision to allow the items of laundry to be ironed to be transported in a manner directed from the top downward to the inlet region 19 and/or to run from the inlet region 19 into the ironer gap 18.

The items of laundry are preferably supplied to the band ironer 10 at the inlet region 19 lying almost lower than the outlet region, in particular are introduced to the or into the beginning of the ironer gap 18. This can take place according to the exemplary embodiments of FIGS. 1 and 2 by means of a transfer conveyor between the input machine 11 and the band ironer 10. Said transfer conveyor 30 can be part of the input machine 11, but also of the band ironer 10. From the transfer conveyor 30 or another transport member, the items of laundry to be ironed pass directly to the inlet region 19 on that side of the band ironer 10 which points toward the transfer conveyor 30 of the input machine 11 or another laundry machine.

The items of laundry to be ironed are supplied to the inlet region 19 which is arranged upstream of the ironer body 15, as seen in the ironing direction 12 or pass-through direction of the items of laundry through the ironer line. As a result of the lower inlet region 19, preferably the arrangement of the inlet region 19 on or somewhat above the horizontal longitudinal center plane 19 of the ironer body 15, the items of laundry to be ironed pass with a downwardly directed transverse edge, which can be the shorter or longer edge of the item of laundry to be ironed in each case, in front into the ironer gap 18 and/or to the beginning of the ironer gap 18. The items of laundry to be ironed therefore drop due to gravity in the inlet region 13 into the ironer gap 18, which at least reduces the risk of disturbances or creasing.

As a result of the lower arrangement of the inlet region 19 on or in the vicinity of the horizontal longitudinal center plane 29 of the ironer body 15 or tightly above said plane or optionally tightly therebelow, the running direction of the ironer band 17 guided up to the lateral surface 16 of the ironer body 15 by the deflecting drum 21 in the inlet region 19 is directed downward in front of the beginning of the ironer gap 18, specifically either slightly obliquely downward or perpendicularly. The ironer band 17 which is guided at the inlet region 19 up to the lateral surface 16 of the ironer body 15 thereby assists the downwardly directed movement of the items of laundry to be ironed into the ironer gap 18. This also leads to the risk of operational disturbances or of creasing being at least significantly reduced.

Owing to the fact that the inlet region 19 is arranged with a smaller distance above the horizontal longitudinal center plane 26 than the outlet region 20, and the inlet region 19 can optionally even lie in the horizontal longitudinal center plane 29, it is particularly advantageously possible to supply the items of laundry to be ironed to the ironer gap 18 from above and/or to transport same in the downward direction into the ironer gap 18. In particular, the items of laundry to be ironed can pass from above and/or assisted by their deadweight into the lower inlet region 19, which is located in the vicinity of the horizontal longitudinal center plane 29 or on the latter, and into the inlet gap 18 between the ironer body 15 and the ironer band 17.

The supplying and/or introduction of the items of laundry to be ironed into the ironer gap 18 in a manner taking place in a downward direction as a result of the lower inlet region 19 enables the items of laundry to be ironed to also pass at the inlet region 19 in a reliable and above all crease-free manner into the ironer gap 18 without any inlet aids whatsoever and also optionally supported by the ironer band 17, which is driven circumferentially in the ironing direction 12.

The ironer gap 18 extends over a large part of the circumference of the ironer body 15, in particular over a region of 300° to 330°. As a result, an ironer gap 18 of greatest possible length is formed, which contributes to the effective ironing of the items of laundry in the band ironer 10. On account of the ironer band 17 wrapping around the ironer body 15 to the maximum extent, the outlet region 20 lies above or obliquely above the inlet region 19, i.e. on that side, in particular the front side, of the ironer body 15 to which the items of laundry to be ironed are supplied to the ironer gap 18. The ironed items of laundry are therefore deflected at the deflecting drum 25 in the region of the outlet region 20 and transported on the empty strand 36 of the ironer band 17, which strand is guided beyond the ironer body 15 and is horizontal or inclined obliquely with respect to the horizontal, onto the opposite side, in particular the rear side, of the ironer body 15 or of the band ironer 10 in order to be transported away there from the band ironer 10 to a following laundry treatment device.

LIST OF DESIGNATIONS

10 band ironer
11 input machine
12 ironing direction
13 folding machine
14 chest ironer
15 ironer body
16 lateral surface
17 ironer band
18 ironer gap
19 inlet region
20 outlet region
21 deflecting drum
22 deflecting drum
23 deflecting drum
24 deflecting drum
25 deflecting drum
26 longitudinal center axis
27 pressure medium cylinder
28 vertical longitudinal center plane
29 horizontal longitudinal center plane
30 transfer conveyor
31 bridge
32 guide plate
33 fan
34 airstream
35 gap
36 strand
37 transfer conveyor

What is claimed is:

1. A method for ironing items of laundry between at least one ironer body and at least one circumferentially drivable ironer band, which is assigned to the ironer body, of a band ironer, the items of laundry being transported by the ironer band in the ironing direction through an ironer gap, which extends from an inlet region as far as an outlet region, between the at least one ironer body and the at least one ironer band, wherein:

the ironer body is positionally fixed and stationary;

the items of laundry to be ironed are supplied to the ironer gap in a manner directed downward in the inlet region;

the items of laundry drop from above the ironer gap into the ironer gap; and the items of laundry first come into contact with the at least one ironer band and subsequently with the stationary ironer body upstream of the ironer gap.

2. The method as claimed in claim 1, wherein the items of laundry are supplied to the inlet region of the band ironer, said inlet region being located lower than the outlet region.

3. The method as claimed in claim 1, wherein the items of laundry to be ironed are supplied to the lower inlet region at or with a small distance from the horizontal longitudinal center plane through a longitudinal center axis of the at least one ironer body.

4. The method as claimed in claim 2, wherein, at the lower inlet region, the ironer band is deflected by at least 180° on an optionally driven deflecting drum.

5. The method as claimed in claim 2, wherein, at the lower inlet region, the items of laundry to be ironed are transported directly in a downwardly directed manner into the ironer gap.

6. The method as claimed in claim 2, wherein only in a region of the beginning of the ironer gap do the items of laundry to be ironed first of all come into contact with the at least one ironer band and only subsequently with the ironer body, wherein the items of laundry are carried along by the ironer band.

7. The method as claimed in claim 1, wherein the items of laundry to be ironed are supplied to the ironer gap via the inlet region on that side of the ironer body which lies upstream of the ironer body in the ironing direction.

8. The method as claimed in claim 1, wherein, on the same side on which the inlet region is located, the ironed items of laundry are transported away from the outlet region of the ironer band to a side of the ironer body lying opposite the inlet region and the outlet region of the ironer body.

9. A band ironer for ironing items of laundry, comprising at least one heatable ironer body and at least one circumferentially drivable ironer band which is assigned to the at least one ironer body, the items of laundry being transported by the at least one ironer band through an ironer gap between the at least one ironer body and the at least one ironer band from an inlet region at the beginning of the ironer gap, as seen in the ironing direction, as far as the outlet region at the end of the ironer gap, wherein the ironer body is configured to be positionally fixed and stationary, the inlet region is arranged lower than the outlet region, the items of laundry drop from above the ironer gap into the ironer gap, and the items of laundry first come into contact with the at least one ironer band and subsequently with the stationary ironer body upstream of the ironer gap.

10. The band ironer as claimed in claim 9, wherein the inlet region and the outlet region are assigned to the same side of the at least one ironer body.

11. The band ironer as claimed in claim 9, wherein the inlet region is arranged on a horizontal longitudinal center plane through a horizontal longitudinal center axis of the at least one ironer body.

12. The band ironer as claimed in claim 10, wherein the outlet region is arranged at a distance above the horizontal longitudinal center plane.

13. The band ironer as claimed in claim 9, wherein the inlet region and the outlet region are assigned to that side of the at least one ironer body from which the items of laundry to be ironed are supplied.

14. The band ironer as claimed in claim 9, wherein at least one deflecting drum forming the beginning of the ironer gap is assigned to the inlet region.

15. The band ironer as claimed in claim 9, wherein at least one discharging aid for ironed items of laundry is assigned to the outlet region which is arranged on the side of the inlet region somewhat above the latter.

16. The band ironer as claimed in claim 9, wherein the at least one ironer band is returned from the outlet region on the outside around the at least one ironer body to the inlet region.

17. The band ironer as claimed in claim 9, wherein the at least one ironer band is guided from the outlet region beyond the at least one ironer body to the inlet region on that side of the at least one ironer body which lies opposite the outlet region for transporting away ironed items of laundry onto that side of the at least one ironer body which lies opposite the inlet region and the outlet region.

18. A band ironer for ironing items of laundry, comprising:

at least one heatable ironer body;

at least one circumferentially drivable ironer band which is assigned to the at least one ironer body, the ironer band having a deflecting drum; and a transfer conveyor, wherein the items of laundry are transported by the at least one ironer band through an ironer gap between the at least one ironer body and the at least one ironer band from an inlet region at the beginning of the ironer gap, as seen in the ironing direction, as far as the outlet region at the end of the ironer gap, wherein the ironer body is configured to be positionally fixed and stationary, wherein the inlet region is arranged lower than the outlet region and is in the form of an upwardly open V-shaped inlet region, wherein the deflecting drum is spaced from the ironer body and the transfer conveyor is arranged above the deflecting drum.

19. The method as claimed in claim 8, wherein the ironed items of laundry are transported away from the outlet region of the ironer band with the aid of at least one discharging means.

20. The method as claimed in claim 19 wherein the ironed items of laundry are transported away from the outlet region of the ironer band beyond the ironer body to a rear side of the ironer body.

* * * * *